US010683603B1

(12) United States Patent
Henry et al.

(10) Patent No.: US 10,683,603 B1
(45) Date of Patent: Jun. 16, 2020

(54) CLOTHES DRYING SYSTEM

(71) Applicants: David Lee Henry, Edina, MN (US); Joe Bruce Scott, Lubbock, TX (US)

(72) Inventors: David Lee Henry, Edina, MN (US); Joe Bruce Scott, Lubbock, TX (US)

( * ) Notice: Subject to any disclaimer, the term of this patent is extended or adjusted under 35 U.S.C. 154(b) by 237 days.

(21) Appl. No.: 15/827,523

(22) Filed: Nov. 30, 2017

Related U.S. Application Data

(60) Provisional application No. 62/428,627, filed on Dec. 1, 2016.

(51) Int. Cl.

| | |
|---|---|
| ***D06F 57/04*** | (2006.01) |
| ***D06F 57/12*** | (2006.01) |
| ***A47G 25/02*** | (2006.01) |
| ***A47G 25/30*** | (2006.01) |
| ***A47G 25/50*** | (2006.01) |
| ***A47G 25/06*** | (2006.01) |

(52) U.S. Cl.
CPC ..... *D06F 57/04* (2013.01); *A47G 25/02* (2013.01); *A47G 25/0614* (2013.01); *A47G 25/30* (2013.01); *A47G 25/50* (2013.01); *D06F 57/12* (2013.01)

(58) Field of Classification Search
CPC ..... A47G 25/00–06; A47G 25/0607–0692; A47G 25/065; A47G 25/08–10; A47G 25/14; A47G 25/145; A47G 25/16–52; A47G 25/441–488; A47G 25/74; A47G 25/746; D06F 57/00–12; D06F 57/122–127
See application file for complete search history.

(56) References Cited

U.S. PATENT DOCUMENTS 660,316 A * 10/1900 Shoenberg ..... A47G 25/486 24/490
1,114,294 A * 10/1914 Routstone ..... A47G 25/4053 223/89
1,318,257 A * 10/1919 Blaustein ..... A47G 25/0685 211/99
1,484,534 A * 2/1924 Rauch ..... A47G 25/30 223/92
1,557,251 A * 10/1925 Hamlin ..... A47G 25/0685 211/85.3
1,799,717 A * 4/1931 Wilson ..... A47G 25/486 24/490
2,142,830 A * 1/1939 Wendell ..... A47B 61/02 211/100
2,489,565 A * 11/1949 Elston ..... A47G 25/481 223/91
D157,089 S * 1/1950 Saunders ..... A47G 25/481 D6/318
2,609,104 A * 9/1952 Leach ..... A47G 25/08 224/482
2,637,471 A * 5/1953 Goldschmidt ..... A47G 25/442 223/89
2,656,954 A * 10/1953 Cook, Sr. ..... A47G 25/487 223/90

(Continued)

*Primary Examiner* — Ismael Izaguirre
(74) *Attorney, Agent, or Firm* — Keeley DeAngelo LLP; W Scott Keeley

(57) ABSTRACT

In accordance with example embodiments of the present disclosure, the invention provides a clothes drying system that can be used in a free standing fashion or in combination with a door to allow for the hanging of multiple garments of various shapes, composition and size for drying or storing.

10 Claims, 10 Drawing Sheets

(56) References Cited

U.S. PATENT DOCUMENTS

| | | | | | |
|---|---|---|---|---|---|
| 2,891,705 | A * | 6/1959 | Gray | A47G 25/52 | 223/88 |
| 2,904,233 | A * | 9/1959 | Brothers | A47G 25/26 | 223/88 |
| 3,471,069 | A * | 10/1969 | Simon | A47G 25/485 | 223/91 |
| 3,720,357 | A * | 3/1973 | Bushon | A47G 25/26 | 223/85 |
| 4,807,766 | A * | 2/1989 | Compagnucci | D06F 57/08 | 211/198 |
| 4,901,894 | A * | 2/1990 | Blanchard | A47G 25/28 | 223/96 |
| 5,901,888 | A * | 5/1999 | Schneider | A47G 25/403 | 223/88 |
| 6,202,905 | B1 * | 3/2001 | Heide | A47G 25/743 | 223/88 |
| 7,806,280 | B1 * | 10/2010 | Perkins | A47G 25/0685 | 211/100 |

* cited by examiner

400

400

CLOTHES DRYING SYSTEM

TECHNICAL FIELD

The present invention relates to a clothes drying mechanism. In particular, it relates to a system that has been designed and engineered to facilitate the effective and comprehensive drying of garments.

BACKGROUND

Consumers frequently have a need to air dry their clothing garments by hanging them on or over an object, such as a standard clothes hanger or clothes line. However, consumers also have additional clothes drying needs, such as: minimizing unwanted creases caused by the use of hangers or lines; preventing small garments or specialty garments made from sheer material, such as silk, from falling off the hanger or line; storing garments in a self-contained fashion; and increasing the number of garments that can be dried at one time.

Based on the foregoing, a need exists for a flexible clothes drying system that can be used in a free standing fashion or in combination with a standard door to allow for the hanging of multiple garments of various shapes, composition and size while simultaneously minimizing wrinkles, creases and the need to iron garments.

SUMMARY

The present invention is a Clothes Drying System that allows the user to dry clothes of varying shapes, composition and size (i.e., short sleeved shirts, blouses, long sleeved shirts, sweaters, pants, jeans, shorts, skirts, or undergarments). Expandable drying hangers allow the majority of garments to dry in a hanging orientation. A garment rod attachment for a drying hanger supports smaller articles of clothing.

In one embodiment a central module houses a hook, such as a coat hanger hook. The central module has receptacles for receiving hanger-arms. In an example embodiment the central module receives two hanger arms that reside symmetrically about the central module. Hanger-arms are telescoping to accommodate garments with varying length sleeves. A collet having a key-hole and an elongate hole slides on to a hanger-arm. A collet may be oriented in an upward orientation and be used to support a collar of a garment, or in a downward direction wherein the elongate hole supports a horizontal bar. Two collets, each slid onto a hanger-arm in the down ward orientation support a horizontal bar that further supports clips for supporting garments.

In one embodiment, a clip has paired symmetrical members each having a tab end and a lever end, that are joined about a pivot and are held together with a spring. The spring holds tabs closed, while levers open the tabs by pivoting about the pivot. The lever portion of each of the symmetrical members has a semi-cylindrical through-hole that is configured to snap onto the aforementioned horizontal bar. In other words, the clip assembly holds a garment at one end and affixes to the horizontal bar at the opposite end.

The portion of the Clothes Drying System that comes into contact with each garment is made from anti-slip material to facilitate the drying of specialty clothes made from sleek material, such as silk, from falling off the Clothes Drying System. The Clothes Drying System also includes built-in hooks to store garments in the hanging position when not in use.

Other objects and features will become apparent from the following detailed description considered in conjunction with the accompanying drawings. It is to be understood, however, that the drawings are designed as an illustration and not as a definition of the limits of the invention.

BRIEF DESCRIPTION OF THE DRAWINGS

To assist those of skill in the art in understanding the disclosed Clothes Drying System, reference is made to the accompanying figures, wherein.

DETAILED DESCRIPTION OF THE DRAWINGS

Figure 1:
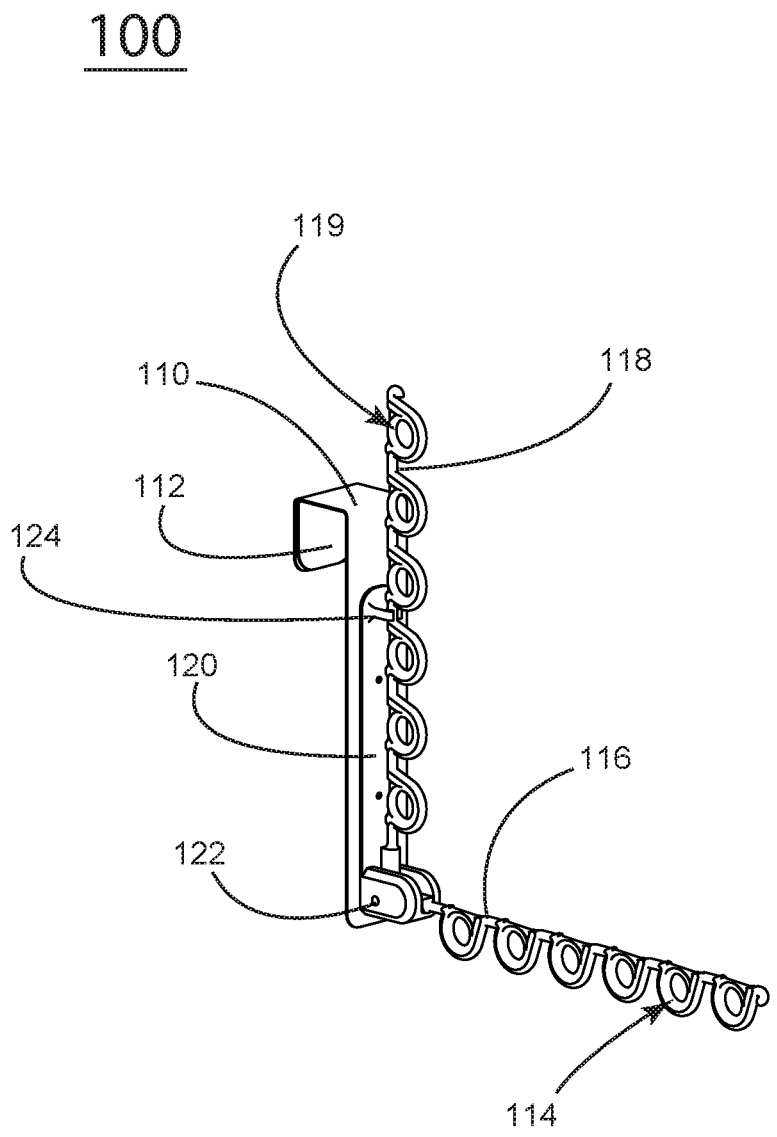
FIG. 1 is a perspective view of the Over-The-Door embodiment of the present invention.

FIG. 1 is a perspective side view of the Over-The-Door embodiment of the present invention 100 comprised of an Over-The-Door Hook Liner 112, Over The Door Hook 110, Hanger Arm Support 116, Eyelets 114 and 118, Support Plate 120, Pivot Arm Base 122, and Upright Arm Hook 124.

The Over-The-Door Hook 110 may be removably attached to the top edge of a door. The Over-The-Door Hook Liner 112 protects the surface of a door from scratching or marring. Arms 116 and 118 provide a means of hanging numerous hangers for drying garments and may be positioned in the upright position as illustrated by arm 118 or in the lowered position as illustrated by arm 116. Arms 116 and 118 pivot about a joint in the pivot arm base 122 and may be affixed in an upright position by upright arm hook 124. Hanger arm eyelets 114 on arm 116 and 119 on arm 118 are holes for receiving clothes hangers.

Figure 2:
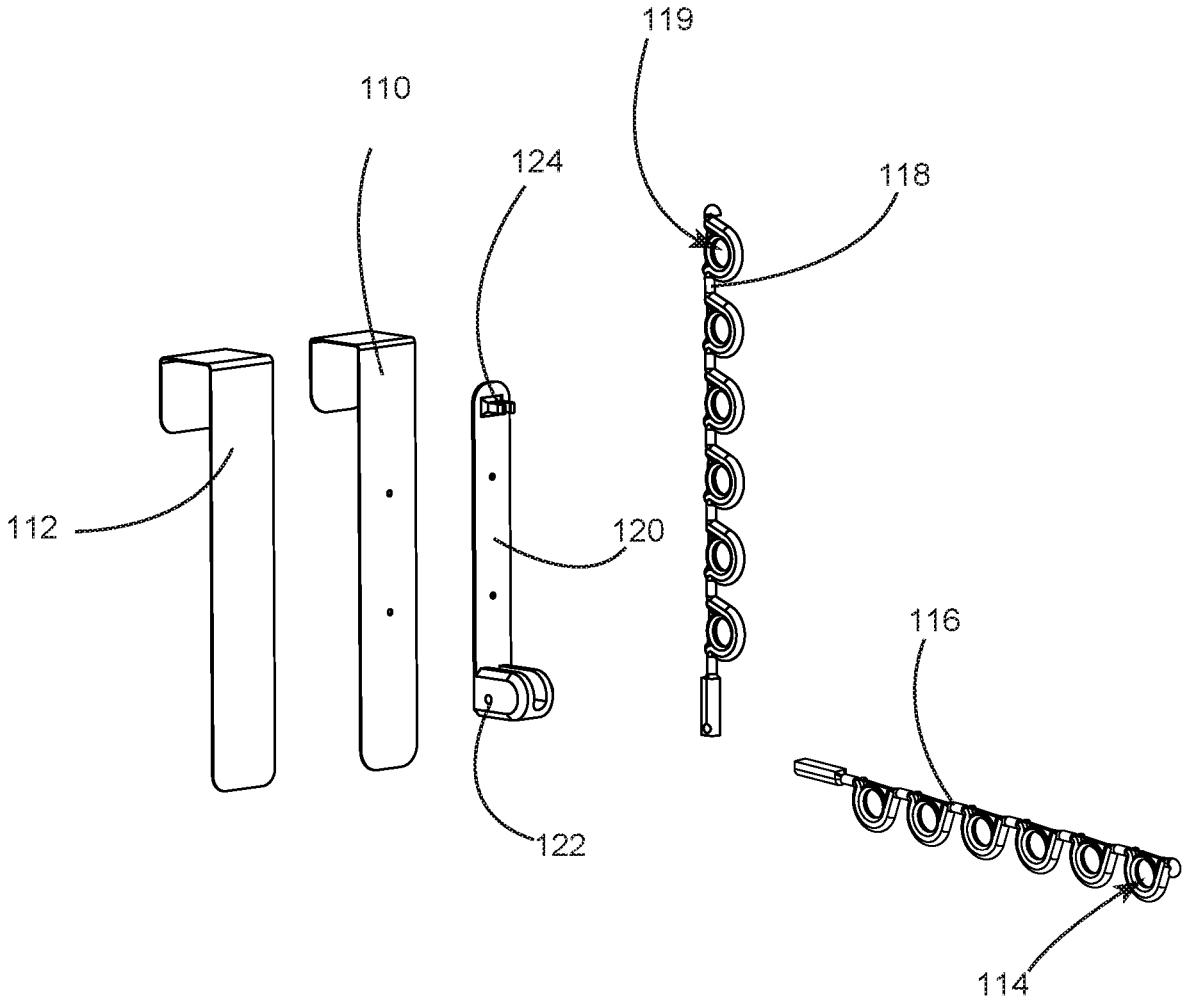
FIG. 2 is an exploded, perspective view of the Over-The-Door embodiment of the present invention.

FIG. 2 is an exploded view of the Over-The-Door embodiment of the present invention 100 comprised of an Over-The-Door Hook Liner 112, Over The Door Hook 110, Hanger Arm Supports 116 and 118, Eyelets 114 and 119, Support Plate 120, Pivot Arm Base 122, and Upright Arm Hook 124.

Figure 3:
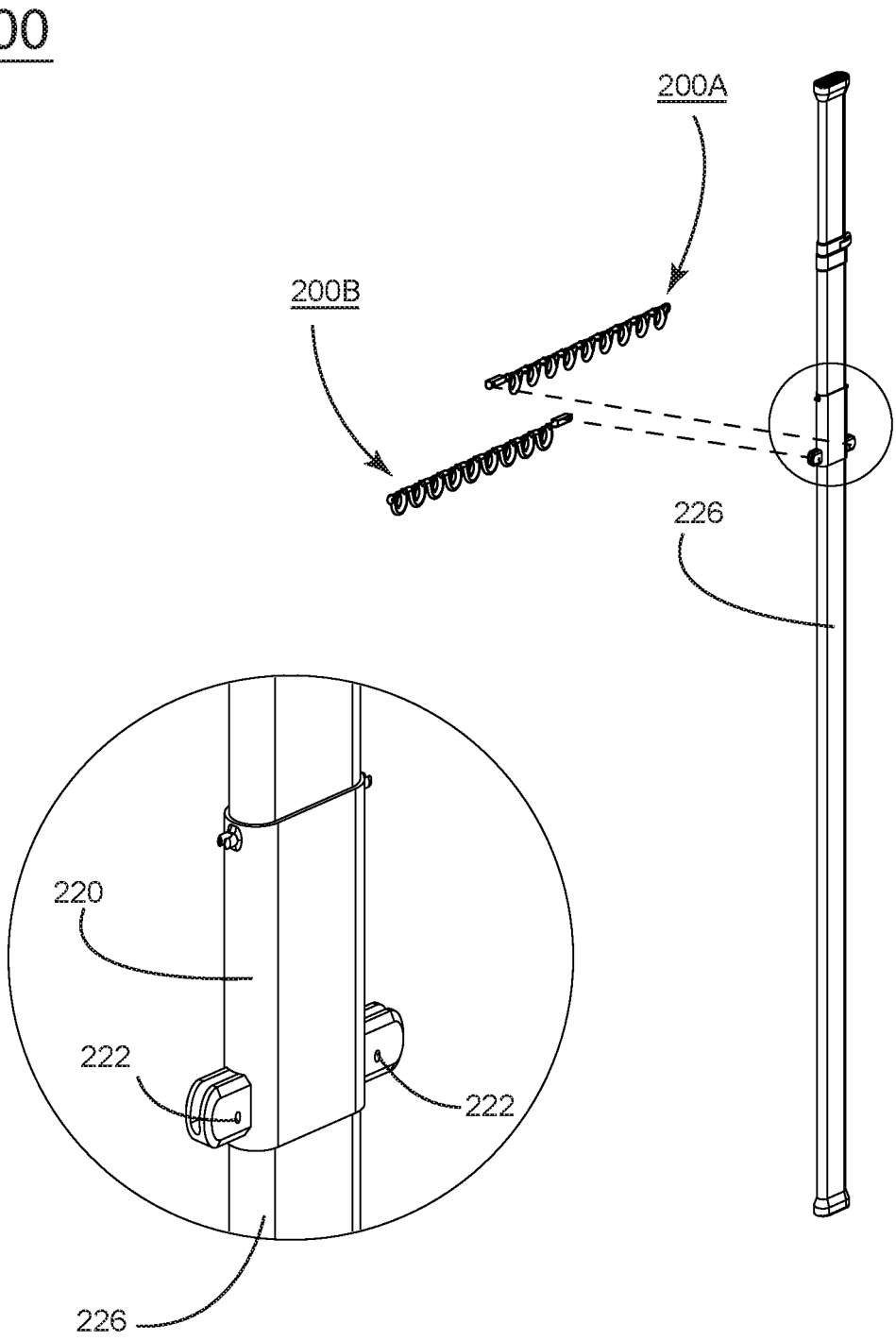
FIG. 3 is a detail, exploded, perspective view of a Free-Standing Telescoping embodiment of the present invention

FIG. 3 is a detail exploded view of the Free Standing Telescoping embodiment of the present invention 200 comprised of a Dual Hanger Support Arm Base Attachment 220, Pivot Arm Base 222, and Telescopic Pole 226. A detailed view illustrates the engagement between the Dual Hanger Support Arm Base Attachment 220 and the telescoping pole 226. Two Over-The-Door hangers, 200A and 200B are shown in exploded view. One skilled in the art understands how the Over The Door hangers 200A and 200B may be engaged with the telescoping pole 226

Figure 4:
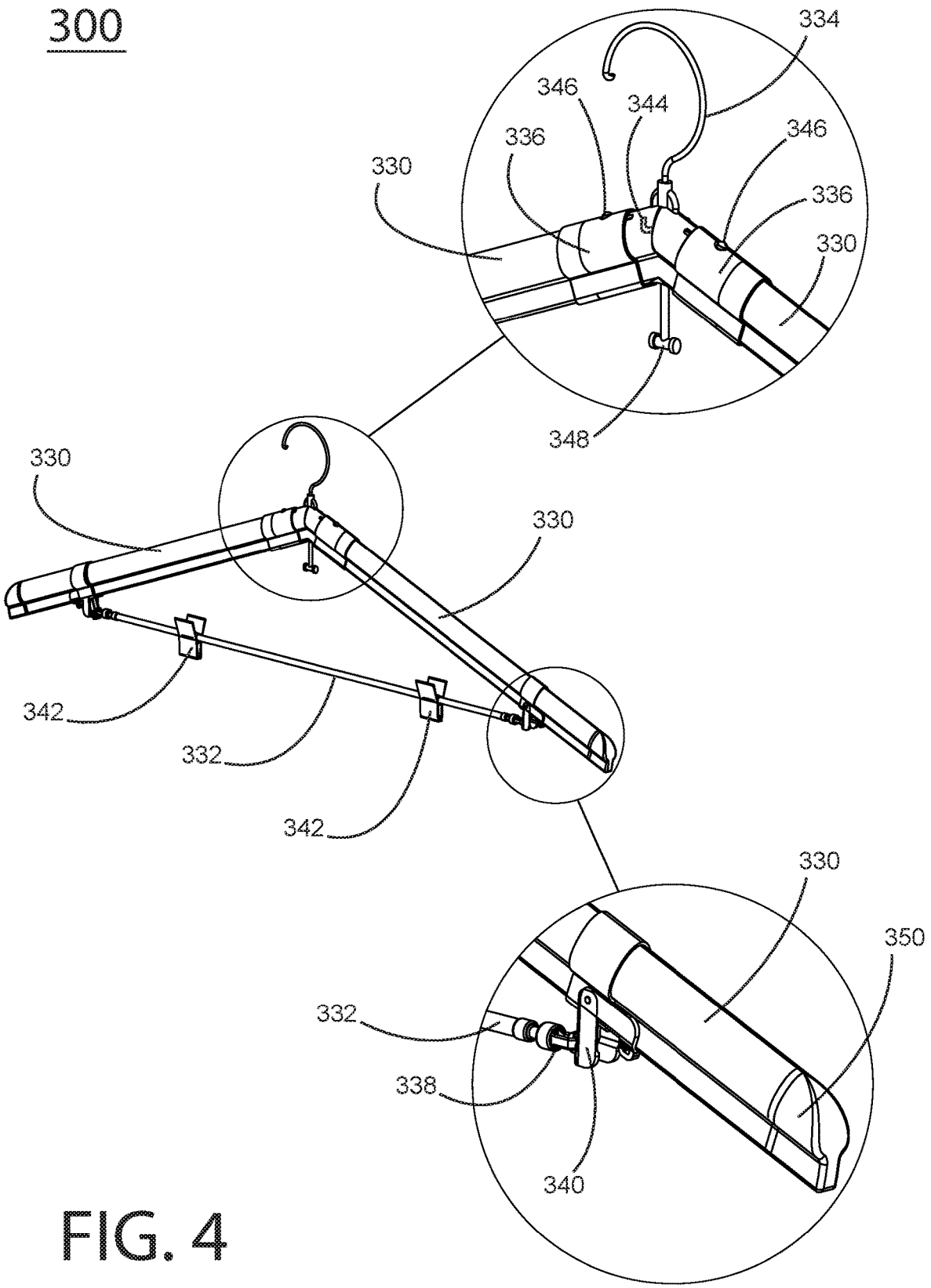
FIG. 4 is a detail, exploded, perspective view of a Clothes Drying System Hanger.

FIG. 4. is an exploded, side view of a Clothes Drying System Hanger 300 comprised of a Cascading Hook 344, Tension Release Button 346, Storage Holder 348, Right/Left Hanger Arms 330, Garment Rod 332, Hanger Hook 334, Central module 336, Garment Rod Eyelet 338, Garment Rod Eyelet Hook 340, Garment Clips 342, and Telescopic Extension Arm—Right/Left Hanger Arms 344. Hanger Arms 330 are extendable in a telescoping manner with 344 Telescopic Extension Arm and are engaged for added sleeve support. Garment rod 332 is stationary and may be engaged or disengaged by removing Garment Rod Eyelet Hook 340 from Garment Rod Eyelet 338.

Figure 5:
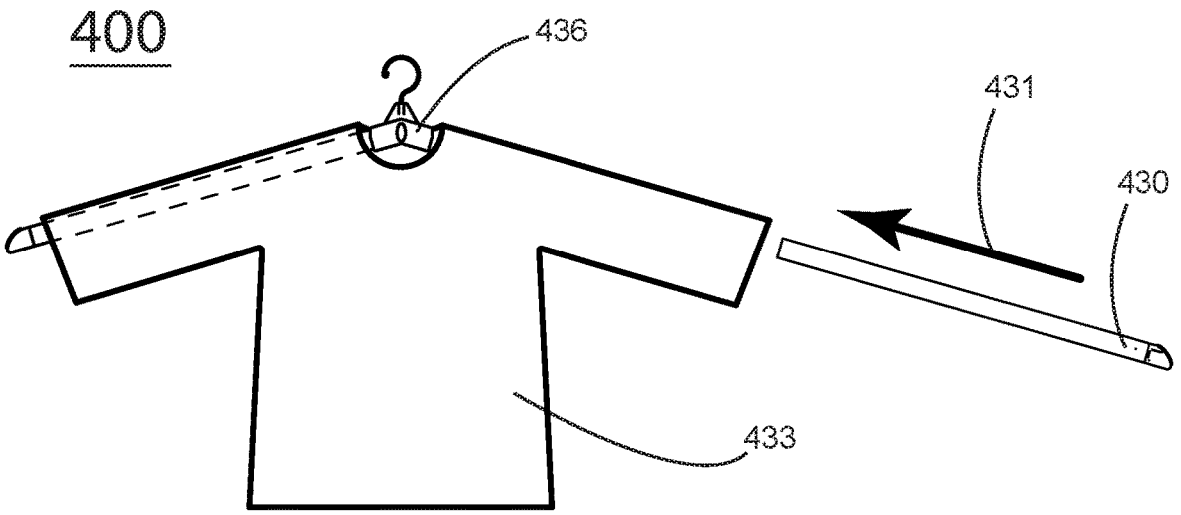
FIG. 5 is a front view of the Clothes Drying System Hanger in use with a garment.
Figure 6:
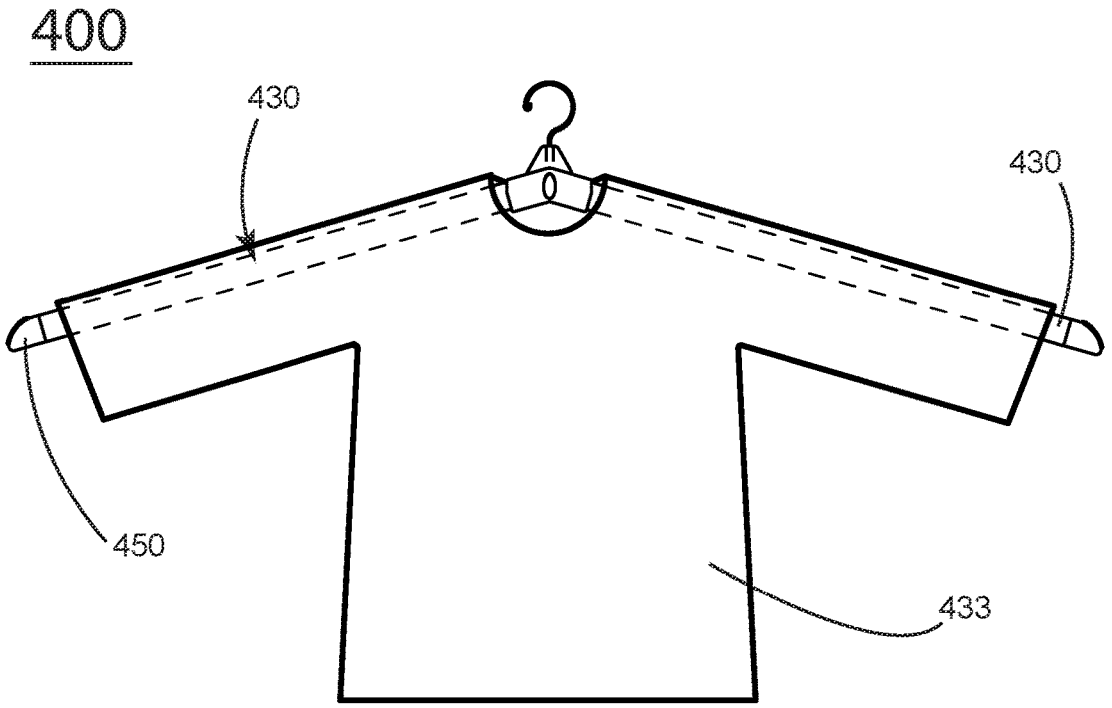
FIG. 6 is a front view of the Clothes Drying System Hanger in use with a garment.

Referring to FIG. 5 and FIG. 6, an iteration of the embodiment 400 is depicted in the illustration. The central module 436 with removable hanger arms 430 are used in combination with a garment 433. One of a pair of removable hanger arms 430 is removed from the central module 436, the garment is placed on one hanger arm, the previously removed hanger arm 430 is inserted into the sleeve of the garment 433 and moved in the direction indicated by arrow 431, through the sleeve and into the central module 436. The assembled combination is depicted in FIG. 6. Dashed lines denote hidden edges of hanger arms 430 inside the garment 433.

Figure 7:
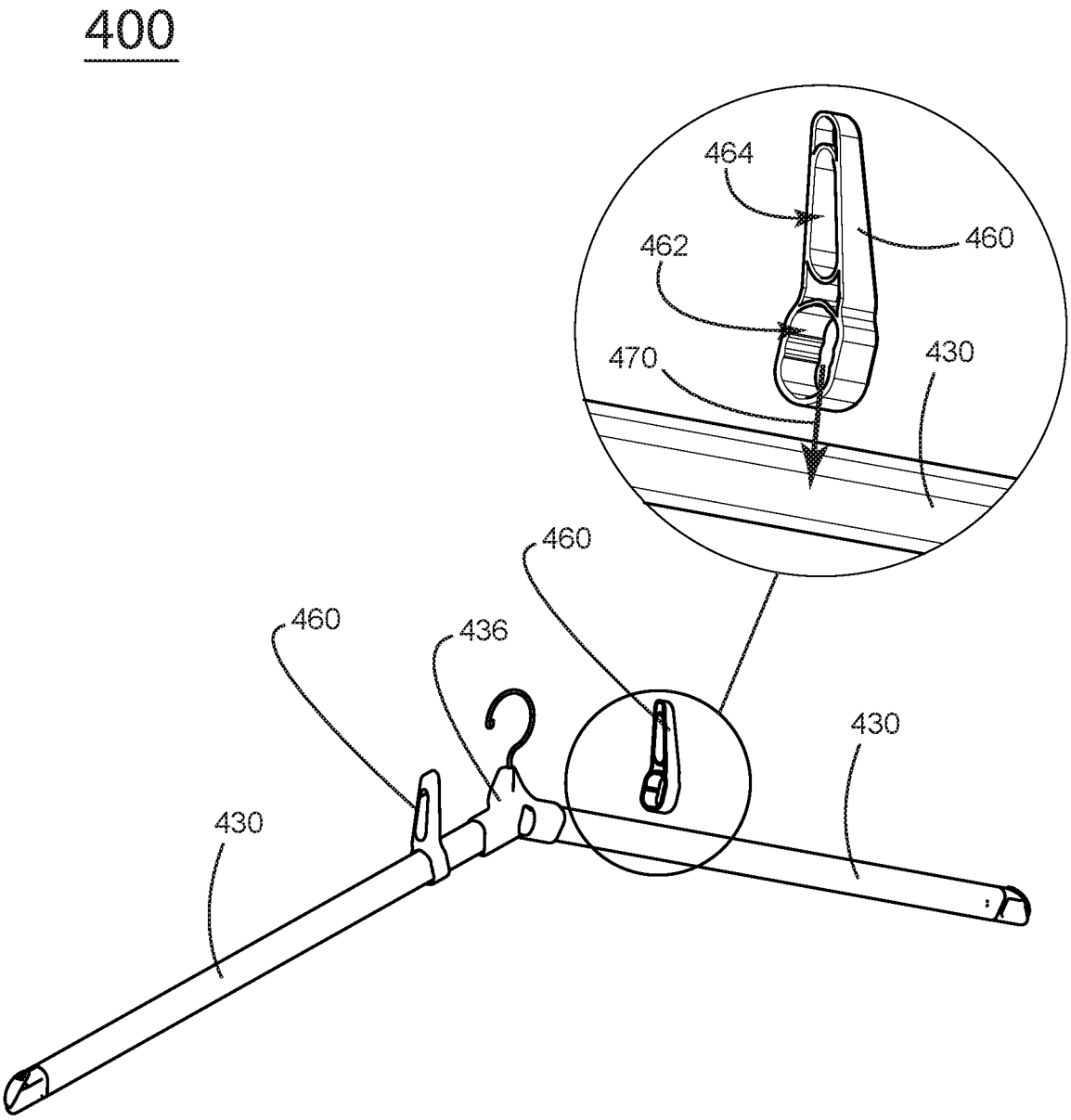
FIG. 7 is a detail, exploded, perspective view of an iteration of a Clothes Drying System Hanger of the present embodiment.

Referring to FIG. 7, an exploded view of the iteration of FIG. 5 and FIG. 6 is depicted in combination with a collet 460. The collet 460 has a key hole 462 and an elongate hole 464. The key hole 462 engages with a hanger arm 430 by sliding the collet 460 onto the hanger arm 430 so that it resides on the hanger arm in the location depicted by arrow 470. In other words, the key hole 463 receives the hanger arm 430 such that it is located in the position denoted by arrow 470.

Figure 8:
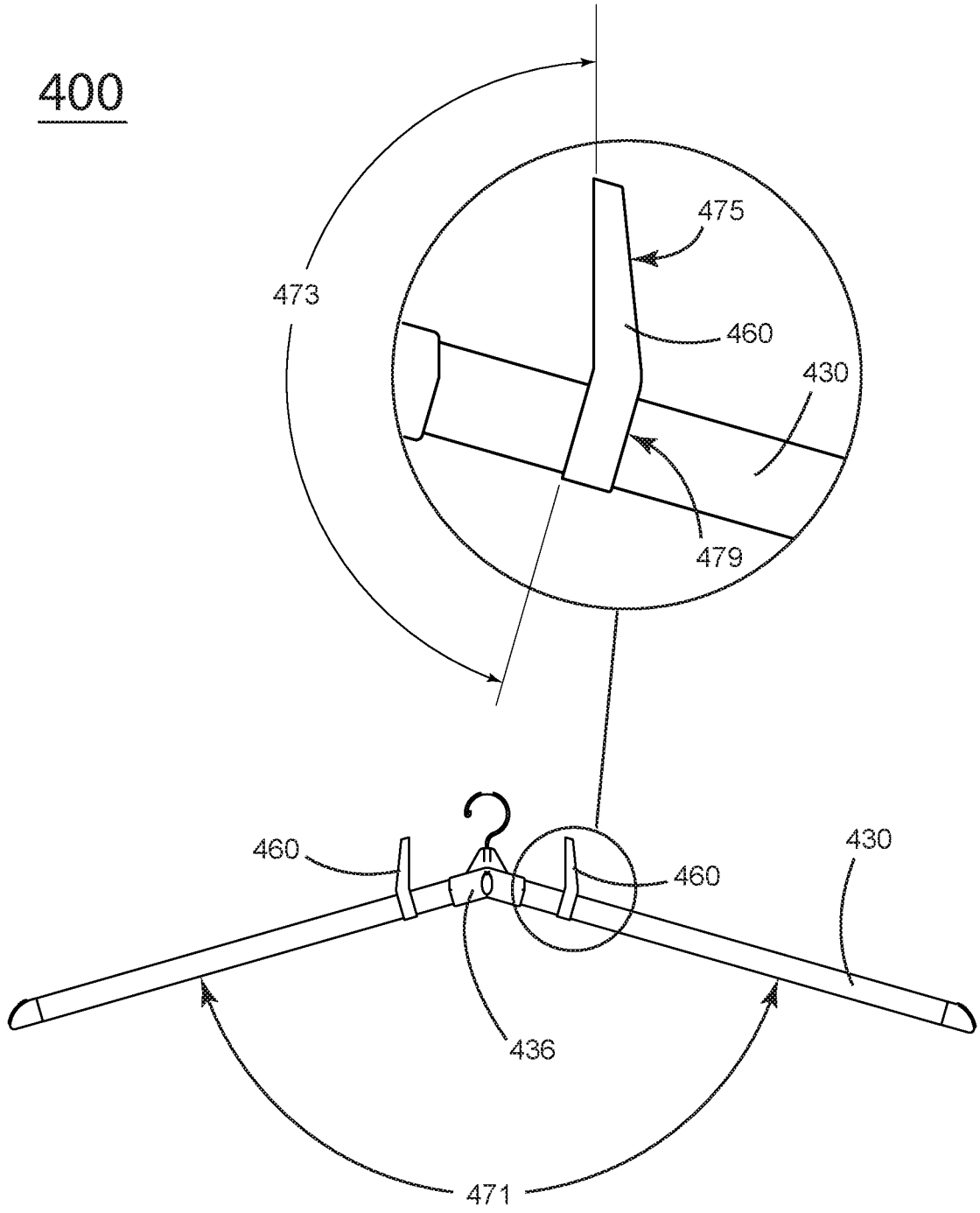
FIG. 8 is a detail, front view of the Clothes Drying System Hanger in use with a garment.
Figure 9:
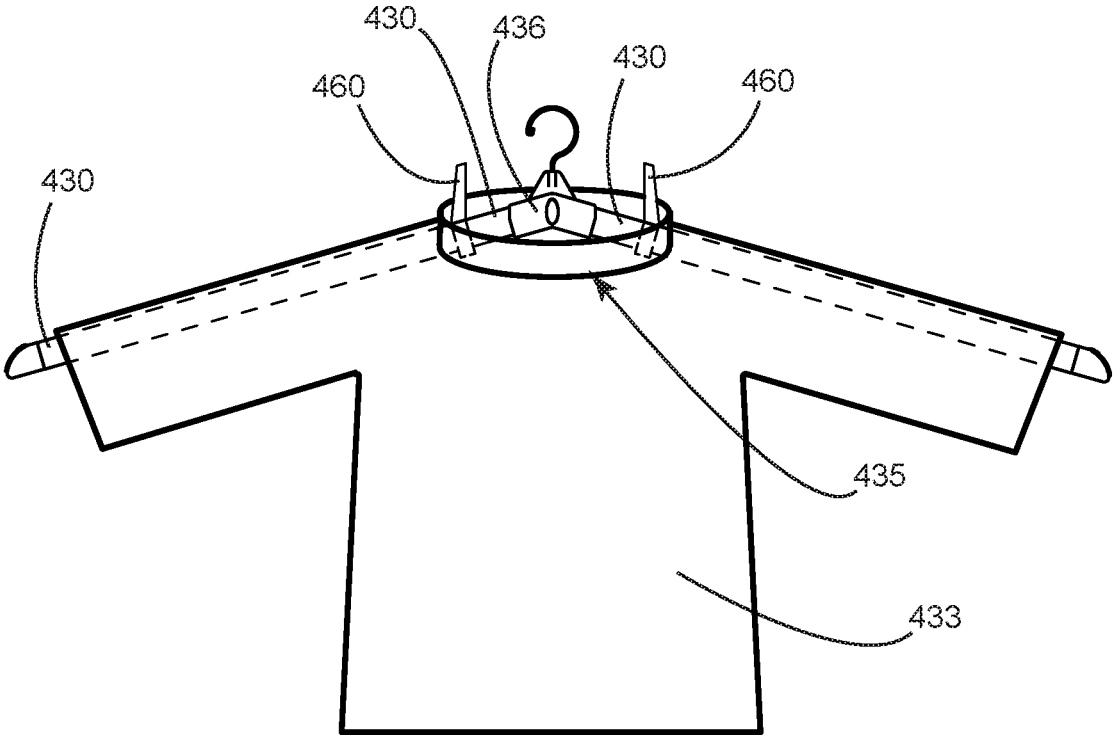
FIG. 9 is a front view of the Clothes Drying System Hanger in use with a garment.

Referring to FIG. 8 and FIG. 9, the iteration of the embodiment 400 is depicted in the illustration in combination with a garment 433 and two collets 460. The central module 436 is engaged with two hanger arms 430 and each hanger arm is engaged with a collet 460. The hanger arms support the sleeves of the garment 433 while the collets 460 support the collar 435 of the garment 433. The hanger arms 430, when placed in the receptacles of the central module 436 reside at an angle 471 that is between 135° and 150°, preferably 145°. The detail view in FIG. 8 depicts an example collet 460, the collet 460 having an angle between the structure 479 that surrounds the key hole 462 (FIG. 7) and a structure 475 that surrounds the elongate hole 464 (FIG. 7) and an angle 473 between the two that is between 150° and 170°, preferably 163°. One skilled in the art understands that supporting a collar in this manner allows the collar to dry in an appropriate form, thus mitigating the need for ironing.

Figure 10:
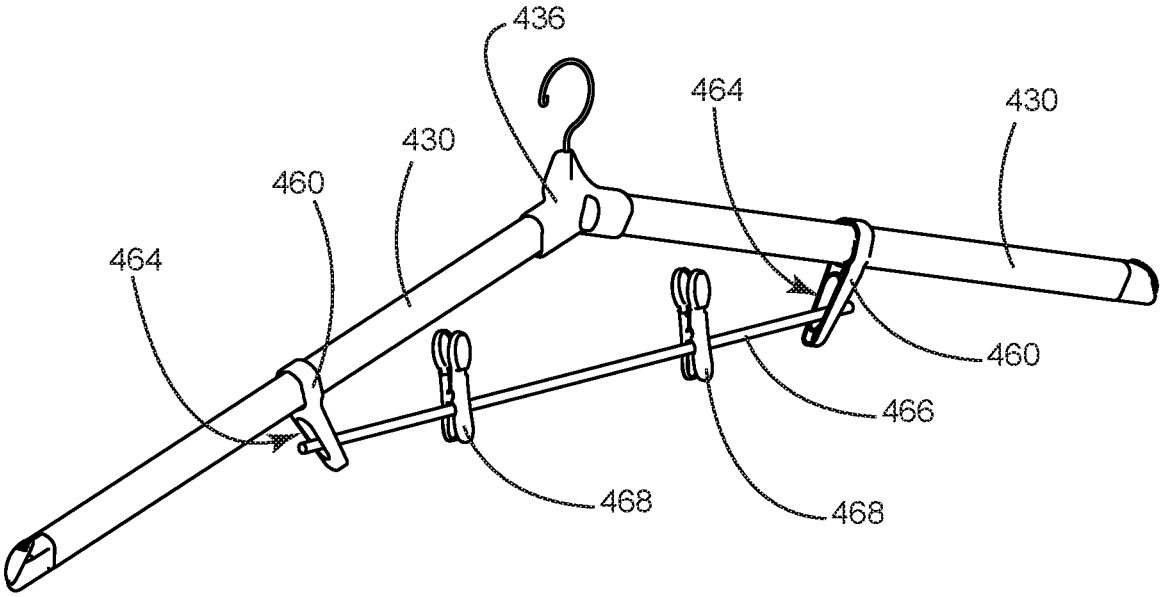
FIG. 10 is a detail, exploded, perspective view of an iteration of a Clothes Drying System Hanger of the present embodiment.

Referring to FIG. 10, a configuration of the iteration of FIGS. 5-9 is depicted in the illustration. Hanger arms 430 are engaged with a central module 436. Collets 460 are engaged with hanger arms 430 in a position that is inverted from the configuration in FIG. 9. Holes 464 in collets 460 receive a bar 466. The bar 466 supports clips 468. One skilled in the art understands the use of a bar 466 in combination with clips 468 to hold garments such as trousers, under garments and the like for drying or storage.

Figure 11:
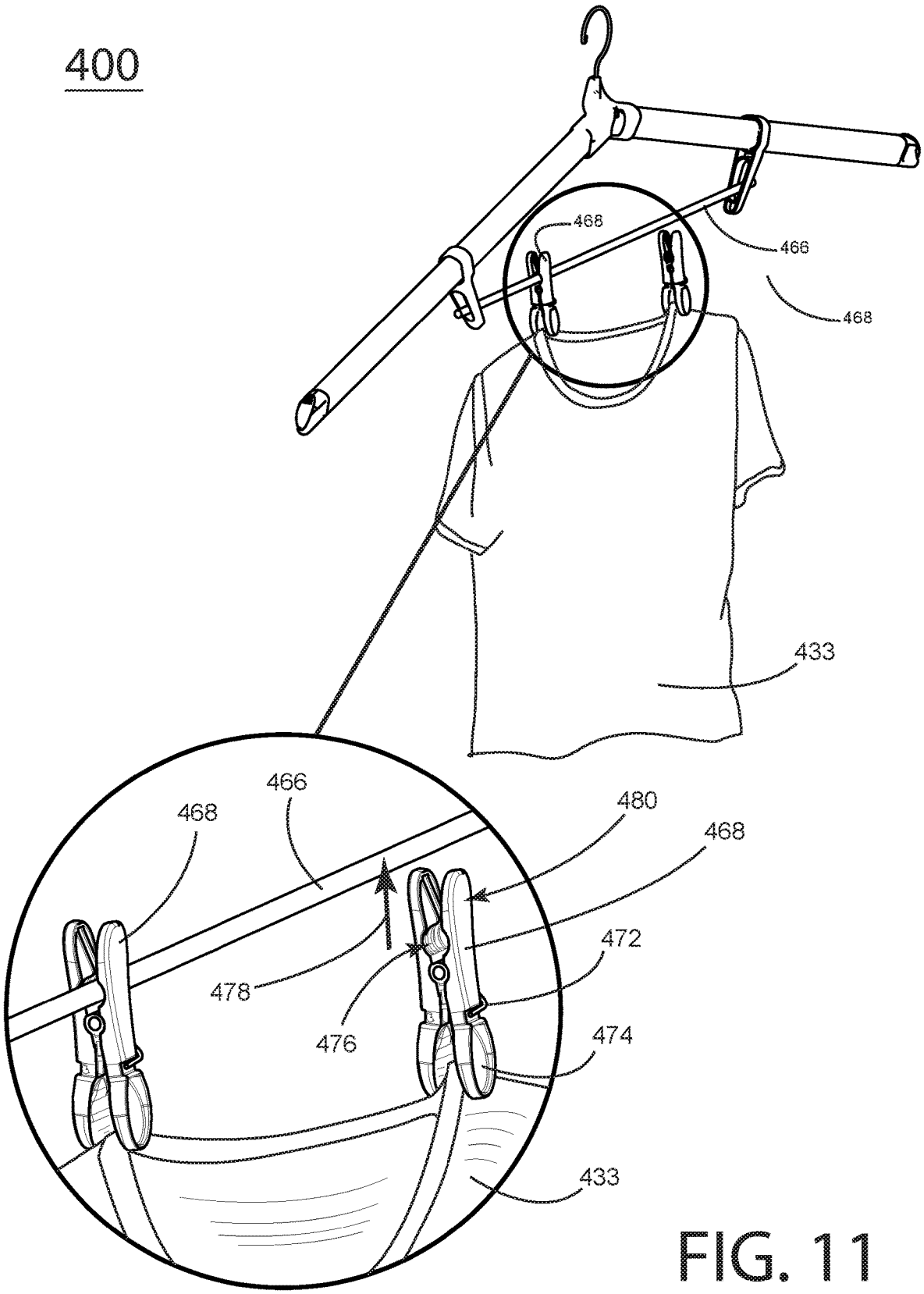
FIG. 11 is a detail, exploded, perspective view of an iteration of a Clothes Drying System Hanger of the present embodiment.

Referring to FIG. 11, a detail, partially exploded view showing the function of a clip of the present embodiment is depicted in the illustration. A pair of clips 468 are used to hold a garment 433 for hanging and drying. Clips 468 have tabs 474 for engaging with a garment 433. A spring 472 holds clip members together in a manner that allows clips to open when levers 480 are pressed together. One skilled in the art is familiar with the function of a common clothes pin that opens and closes in a similar manner. The clip 468 has a cylindrically shaped opening 476 in the levers 480. The cylindrically shaped opening engages with the rod 466 when moved onto the rod in the direction indicated by arrow 478. The cylindrically shaped opening 476 surrounds the rod 466 thus holding the clips and garment 433 to the rod 466.

While the present invention is described above in connection with preferred or illustrative examples and these examples are not intended to be exhaustive or limiting of the invention. Rather, the invention is intended to cover all alternatives, modifications and equivalents included within its scope, as defined by the appended claims.

The invention claimed is:

1. An apparatus for hanging clothing for drying comprising:

at least one elongate member; and a vertical support structure pivotally engaged with said elongate member; and said elongate member further comprising:

a pivot at a first end; and at least one eyelet for receiving a hook from a clothes hanger at a second end; and said vertical support structure further comprising:

a receiving slot for said pivot; and a clip above said receiving pivot; and said vertical support structure fixedly engaged with a telescoping vertical pole; wherein the at least one elongate member pivots about said pivot in said receiving slot for said pivot and may be moved to a vertical position wherein it is held by said clip or may be moved to a horizontal position when un-clipped and said telescoping vertical pole is sufficiently tall and extendable so as to extend between, and engage under compression, with a floor and ceiling.

2. An apparatus for hanging clothing for drying comprising:

a central module; and at least two hanger arms; and at least two collets; and the central module further comprising:

a hook; and at least two receptacles for receiving one end of each of said at least two hanger arms; and said at least two collets each further comprising:

a key hole; and an elongate hole; wherein each of the at least two hanger arms is fitted into each of the at least two receptacles in the central module and the at least two collets each slidably engages with one of said at least two hanger arms by way of sliding each key hole on to each hanger arm; said collets in an upward orientation support a collar of a garment.

3. The apparatus of claim 2 wherein the horizontal bar supports at least one clip; wherein said clip holds clothing to said horizontal bar.

4. The apparatus of claim 2 wherein the receptacles in the central module removable engage the hanger arms such that the hanger arms reside at an angle between 135° and 150° with respect to each other.

5. The at least two collets of claim 2 wherein each of the collets further comprise a bend having an angle between 150° and 170° the bend residing between the structure surrounding the keyhole and the structure surrounding the elongate hole.

6. An apparatus for hanging clothing for drying comprising:

a central module; and at least two hanger arms; and at least two collets; and a cylindrical rod; and the central module further comprising:

a hook; and at least two receptacles for receiving one end of each of said at least two hanger arms; and said at least two collets each further comprising:

a key hole; and an elongate hole, each elongate hole in each collet removably engaged with one end of said cylindrical rod; wherein each of said at least two hanger arms is fitted into each of the at least two receptacles in the central module and the at least two collets each slidably engages with one of said at least two hanger arms by way of sliding each key hole on to each hanger arm; said collets in a downward orientation support the cylindrical rod.

7. The apparatus of claim 6 further comprising clips removably engaged with said cylindrical rod.

8. The apparatus of claim 6 wherein the receptacles in the central module removable engage the hanger arms such that the hanger arms reside at an angle between 135° and 150° with respect to each other.

9. The at least two collets of claim 6 wherein each of the collets further comprise a bend having an angle between 150° and 170° the bend residing between the structure surrounding the keyhole and the structure surrounding the elongate hole.

10. An apparatus for hanging clothing for drying comprising:

a central module; and at least two hanger arms; and at least two collets; and a cylindrical rod; and at least one clip; and the central module further comprising:

a hook; and at least two receptacles for receiving one end of each of said at least two hanger arms; and said at least two collets each further comprising:

a key hole; and an elongate hole, each elongate hole in each collet removably engaged with one end of said cylindrical rod; and said at least one clip further comprising:

paired symmetrical members pivotally engaged about a spring; and said spring holding paired symmetrical members together about a pivot; and said symmetrical members each having tabs at one end for engaging portions of garments; and said symmetrical members each having lever portions opposite ends of said tabs; and said symmetrical members each having a semi-cylindrical hole in the lever portion;

wherein each of the at least two hanger arms is fitted into each of the at least two receptacles in the central module and the at least two collets each slidably engages with one of said at least two hanger arms by way of sliding each key hole on to each hanger arm; said collets in a downward orientation support the cylindrical rod; said clips when flexed about said pivot cause said tabs to separate for engaging a garment and said semi-cylindrical holes in said symmetrical members removably affixing to said cylindrical rod when flexed and moved so as to cause said semi-cylindrical openings to surround said cylindrical rod.

* * * * *